US005950510A

United States Patent [19]

Scheffer et al.

[11] Patent Number: 5,950,510

[45] **Date of Patent: *Sep. 14, 1999**

[54] DECELERATING MECHANISM FOR PRINTED PRODUCTS

[75] Inventors: Bruce A. Scheffer, Valparaiso; Eric K. Lo, Portage; James E. Hoolehan, Munster; Thomas J. Payer, Valparaiso, all of Ind.

[73] Assignee: Scheffer, Inc., Merrillville, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/496,822

[22] Filed: Jun. 29, 1995

[51] Int. Cl.[6] ..... B26D 7/32; B65H 29/68

[52] U.S. Cl. ..... 83/23; 83/88; 83/93; 83/101; 83/110; 271/182

[58] Field of Search ..... 83/23, 26, 27, 83/88, 93, 100, 101, 110, 155; 271/69, 182; 6/202

[56] References Cited

U.S. PATENT DOCUMENTS

| | | | |
|---|---|---|---|
| 3,178,174 | 4/1965 | Schneider | 271/202 X |
| 3,315,956 | 4/1967 | Lyman | 271/69 X |
| 3,380,381 | 4/1968 | Musgrave . | |
| 3,685,823 | 8/1972 | Chambon | 271/182 |
| 3,703,282 | 11/1972 | Henkel . | |
| 3,994,221 | 11/1976 | Littleton . | |
| 4,040,617 | 8/1977 | Walkington | 83/88 X |
| 4,040,618 | 8/1977 | Vermes et al. | 271/182 |
| 4,171,655 | 10/1979 | Voorhees . | |
| 4,184,392 | 1/1980 | Wood | 83/88 |
| 4,207,667 | 6/1980 | D'Angelo et al. | 83/23 X |
| 4,346,881 | 8/1982 | Frye | 271/202 X |
| 4,412,467 | 11/1983 | DeSanto . | |
| 4,463,640 | 8/1984 | Cogswell et al. . | |
| 4,466,319 | 8/1984 | Cogswell et al. . | |
| 4,467,687 | 8/1984 | Fokos et al. . | |
| 4,793,229 | 12/1988 | Kleber . | |
| 4,846,030 | 7/1989 | McMahon et al. | 83/155 X |
| 4,896,573 | 1/1990 | Kapolnek . | |
| 4,966,521 | 10/1990 | Frye et al. . | |
| 4,969,640 | 11/1990 | Littleton . | |
| 4,973,039 | 11/1990 | Jeske et al. | 271/182 X |
| 5,039,082 | 8/1991 | Littleton | 271/182 |
| 5,060,928 | 10/1991 | Vits | 271/182 |
| 5,143,368 | 9/1992 | Kiyota et al. . | |
| 5,249,791 | 10/1993 | Belanger et al. | 271/182 |
| 5,366,217 | 11/1994 | Tokuno et al. . | |
| 5,415,389 | 5/1995 | Adami | 83/27 X |
| 5,607,148 | 3/1997 | Mack et al. | 271/182 X |

FOREIGN PATENT DOCUMENTS

| | | | |
|---|---|---|---|
| 2158812 | 11/1985 | United Kingdom | 271/182 |

*Primary Examiner*—Rinaldi I. Rada
*Assistant Examiner*—Charles Goodman
*Attorney, Agent, or Firm*—Welsh & Katz, Ltd.

[57] ABSTRACT

An arrangement for decelerating and shingling printed products as they are conveyed from a variable rotary cutter by a high-speed belt conveyor to a slower speed belt conveyor includes at least one depressor wheel at the entry end of the slower speed conveyor. The depressor wheel carries a plurality of depressor members in circumferential positions corresponding to the circumferential positions of cutting knives on the rotary cutter. The leading edge of each printed product entering the slow speed conveyor enters a headstop nip which reduces the speed of the entering product while its trailing edge is simultaneously momentarily depressed by a depressor on the rotating depressor wheel to enable shingling between successive products. A brake pad cooperates with the depressors to decelerate the printed products to a speed close to the surface speed of the slower belt conveyor. Successive printed products are thus caused to shingle and decelerate irrespective of unequal spacing between the conveyed printed products due to removal by the cutter of dissimilar size transverse blanket gaps or non-image waste strips.

5 Claims, 5 Drawing Sheets

106b
106a
102b
110
102
106
108

106
106a
102
102a
106a
106
106b
108
104
106b 4
106
106
106b
106a
106
102
102b
106
107
104
110
100
106a
106
106
108
110
106b
106
4

DECELERATING MECHANISM FOR PRINTED PRODUCTS

BACKGROUND OF THE INVENTION

The present invention relates generally to apparatus for controlling shingling of printed products conveyed in sequential order from a rotary printing press and variable rotary cutter to a stacking or handling station, and more particularly to novel mechanism for effecting improved deceleration and shingling as each printed product passes from a first high speed conveyor to a slower speed second conveyor.

The speed and efficiency of a rotary printing press is dependent in part on the delivery system following passage of a printed web from the printing press, through an in-line finishing system, if utilized, and then through a rotary cutter operative to cut or sever the printed web transversely into finished or unfinished printed products which are then conveyed to a stacking or other handling station. A common press repeat length of conventional rotary printers is 22¾ inches which is essentially the circumference of the printing plate cylinder of the press. Other press repeat lengths are also employed. When the press repeat length is a single circumference of the printing plate cylinder, it is a conventional practice to make the knife and anvil cylinders of the rotary cutter twice the diameter of the printing plate cylinder for structural strength purposes. A pair of knife blades carried 180° apart on the periphery of the knife cylinder of the rotary cutter will sever the printed web at the end of each press repeat, assuming there is no blanket or blank gap on the forward end of the press repeat length of web and that the rotational speed of the rotary cutter is in timed relation with the speed of the rotary printing press.

It is a conventional practice to accelerate movement of the severed printed products as they leave the rotary cutter so as to create a space between the trailing edge of each product and the leading edge of the next successive product leaving the rotary cutter. Conventional practice further entails conveying the severed products at the accelerated rate along a first conveyor path, generally defined by juxtaposed parallel runs of conveyor belts moving at the accelerated speed, such as a speed 10% greater than the web speed through the print or blanket cylinders, to a second conveyor path defined by at least one conveyor belt moving at a slower speed. To facilitate shingling of the printed products as they enter and are conveyed by the second conveyor toward a stacking or other handling station, it is desirable that the trailing edge of each successive product be depressed momentarily after the product enters the second conveyor and the trailing edge leaves the first conveyor so that the leading edge of the next succeeding printed product passes over the depressed trailing edge to effect shingling.

One known technique for depressing the trailing edge of each successive printed product leaving the first accelerated-movement conveyor path so as to facilitate shingling is to provide a rotary wheel or arm that is rotated in a generally vertical plane at the same rotational speed as the rotary press and on which is mounted a depressor member operative to engage and depress the trailing edge of each successive printed product as it leaves the first conveyor path and enters the slower speed second conveyor path. This technique assists in effecting shingling as long as the repeat length on the rotary press is a full repeat length or is equal to one-half of a full repeat length. In the latter case, a pair of depressors may be mounted on the carrier spaced 180° apart. Alternatively, the rotational speed of the single depressor carrier may be doubled. This, however, creates a problem in that the depressor member is now moving at a tangential velocity greater than the velocity of the printed product received from the accelerated speed conveyor. This tends to increase the surface speed of the product in conflict with the action of the slower speed second conveyor path which is trying to slow down the speed of the product.

Another problem with prior techniques which utilize a rotary arm carrying one or two diametrically opposed depressor members for depressing the trailing edges of successive products leaving the accelerated-speed conveyor path so as to effect product shingling is that they fail to compensate for situations where the rotary press and rotary cutter are designed to produce trimmed and untrimmed printed products having variable longitudinal lengths measuring a fraction of the press repeat length other than one-half, such as one-third, one-fourth, one-fifth or two-thirds of the printing press repeat length. The latter product lengths are commonly described as resulting from "three-around", "four-around", "five-around", etc., press repeats. Further, the prior techniques for effecting shingling of printed products received from a rotary cutter fail to compensate for any transverse scrap or non-image waste strip generally produced between each press repeat length of web or between individual finished products made from the repeat length of web. As a result, where a plurality of printed products are cut from each press repeat, the point of contact between the prior art depressor member and each successive product takes place progressively closer to the trailing edges of the successive products and may actually engage the leading ends of some of the printed products. This creates cumulative error and significantly inhibits desired shingling between successive printed products as they pass from the accelerated speed conveyor path to the slower conveyor path on the way to a stacker or other handling station.

In addition to depressing the trailing edge of each successive printed product passing from the high speed conveyor to the slower speed conveyor to effect shingling of the products disposed on the slower speed conveyor, it is highly desirable that each product be decelerated as it enters the slower conveyor so as to prevent buckling and wrinkling of the individual products. Known systems for delivering printed products in sequential fashion from a printing press effect deceleration of the products after they have entered a reduced speed belt conveyor from a higher speed belt conveyor by causing the leading edge of each product to enter a nip defined between the reduced speed conveyor belts and at least one idler roller. Simultaneously with the leading edge entering this nip, the trailing edge of the product is pressed against the reduced speed conveyor belts by means of a knock-down arm at the upstream end of the second conveyor. A significant problem with this arrangement is that there is no provision for adjustment of the braking action applied to the products, thus failing to enable adjustment of the braking pressure applied to each printed product. Moreover, this arrangement is limited to use with sheet or printed products having equal gaps between successive products.

Thus, a need exists for an arrangement or mechanism which facilitates shingling of printed products being conveyed from a first relatively high speed conveyor to a reduced speed conveyor disposed downstream from a variable rotary cutter operative to cut variable length printed products from a web received from a rotary printer, each printed product being precisely engaged at its trailing edge in timed relation to entering the reduced speed conveyor so as to depress the trailing edge and effect engagement with a stationary brake pad to both decelerate the product and facilitate shingling of printed products carried by the reduced speed conveyor.

SUMMARY OF THE INVENTION

One of the primary objects of the present invention is to provide a novel mechanism for effecting improved shingling of printed products conveyed from a variable rotary cutter disposed downstream from a rotary printing press.

A more particular object of the invention is to provide a novel mechanism for depressing the trailing edges of successive irregularly spaced printed products as they pass from an accelerated-speed conveyor to a slower speed conveyor so as to facilitate shingling of the sheet products, the mechanism being operative to engage the trailing edge of each successive printed product at substantially the same location notwithstanding that an irregular gap occurs periodically between successive products.

A further object of the present invention is to provide a novel mechanism for momentarily depressing the trailing edges of successive irregularly spaced printed products as they pass from a relatively high speed conveyor to a slower speed conveyor downstream from a rotary cutter so as to facilitate shingling of the products, the mechanism including depressors carried on at least one rotary wheel for cooperation with a brake pad to both depress the trailing edge of each printed product and effect deceleration thereof.

Still another object of the present invention is to provide a novel arrangement for decelerating printed products as they are conveyed from a variable rotary cutter through a relatively high speed conveyor to a slower speed conveyor so that the printed products are shingled as they are conveyed by the slower speed conveyor, the arrangement including a plurality of depressor or kicker members carried on a rotating carrier or wheel and operative to accurately engage and depress the trailing edge of each successive printed product as it passes from the high speed conveyor to the slower speed conveyor, and a brake pad cooperative with the depressor members to decelerate each product simultaneously with depressing its trailing edge, the brake pad being adjustable during movement of the products so as to selectively vary the frictional decelerating forces applied to the products and thereby vary the extent of deceleration.

A feature of the present invention lies in the provision of a rotatable depressor or kicker wheel having a plurality of depressor or kicker members carried about its periphery, the depressor members being selectively adjustable about the depressor wheel to enable angular phasing with the positions of the knife blades carried on the variable rotary cutter that create the trailing edges of successive printed products severed from each repeat length of web and being coordinated with the repeat pattern of the rotary printing press so as to accurately engage and depress the trailing edge of each successive printed product into cooperation with a brake pad to selectively decelerate the products and facilitate shingling of the printed products irrespective of the removal of dissimilar size transverse scrap or non-image waste strips between individual products.

Another feature of the invention lies in the utilization of brush bristles as the depressor or kicker members carried about the depressor wheel, the brush bristles being operative to momentarily depress the trailing edge of each successive printed product against the friction pad without adversely affecting the upper printed surfaces of the products.

In carrying out the present invention, an arrangement is provided for decelerating successive printed products as they are conveyed from a variable rotary cutter by a high-speed belt conveyor to a slower speed belt conveyor, the products having been cut to equal lengths by the rotary cutter after receipt from a rotary web printing press. The variable rotary cutter carries a plurality of knife blades which are adjustable about the periphery of the cutter cylinder so as to cut the printed web to remove any blanket gap from the lead end of the press repeat and then butt cut the web transversely to create a number of equal length irregularly spaced printed products as established by the print cylinder during each revolution or press repeat. Alternatively, the knife blades on the cutter cylinder may be positioned to trim any blanket gap created in a given press repeat length of printed web, and to cut out any bleed trim between the resulting equal length printed products within the given press repeat length of web. As a result of the blanket gap cut from each press repeat length of web, the equal length printed products conveyed by the high speed belt conveyor to the lower speed belt conveyor will have unequal spacing between the last product of each press repeat and the first product of the next press repeat.

The decelerating arrangement of the present invention compensates for any unequal spacing between successive printed products conveyed from the high speed conveyor by providing at least one depressor or kicker wheel rotatable in a substantially vertical plane at the entry end of the slower speed conveyor. The depressor or kicker wheel carries a plurality of depressor or kicker members in the form of generally radial bristle brushes which have outer ends lying on a circle concentric with the axis of rotation of the wheel and having a diameter substantially equal to the outer diameter of the knife cylinder. The depressor members are disposed about the kicker wheel in angular circumferential positions corresponding to the angular circumferential positions of the cutting knives on the rotary cutter which create the trailing edge of each successive printed product formed by the rotary cutter.

When a printed product passes from the high-speed belt conveyor immediately downstream of the rotary cutter into the slower speed belt conveyor, the leading edge of the printed product enters a nip defined between one or more transversely aligned headstop idler rollers and the slower moving belt of the second conveyor. This nip operates to immediately reduce the speed of the entering printed product and is positioned downstream from the depressor wheel so that the trailing edge of the product now underlies and is engaged and depressed by the next depressor brush on the rotating depressor wheel. Because the speed of each print product leaving the high speed belt conveyor is substantially the same, the only variable affecting the timing of entry of the printed products into the slower belt conveyor headstop nip is the spacing between successive products passing downstream from the high speed conveyor, as caused by removal of the blanket gap and any bleed trim and from each press repeat length of printed web. By spacing the depressor or kicker brushes about the depressor or kicker wheel in corresponding angular relation to the knife blades on the rotary cutter which established the trailing edges of successive printed products, the specific depressor or kicker brush on the depressor wheel which corresponds to the last-to-cut trailing edge knife blade on the rotary cutter will momentarily engage and depress the trailing edge of the corresponding severed printed product as it enters the slower belt conveyor so as to enable the leading edge of the next succeeding printed product to pass over the depressed trailing edge and effect shingling between successive products.

In order to further decelerate forward movement of each printed product entering the slower belt conveyor, a stationary brake pad is supported slightly below the path traversed by the products passing from the high speed conveyor to the slower speed conveyor and also generally vertically below the rotational axis of the depressor wheel. The brake pad is vertically adjustable so as to cooperate with the depressor or kicker brushes to sandwich the momentarily depressed trailing ends of the printed products between the brushes and the brake pad with sufficient frictional pressure to decelerate the corresponding printed product close to the surface speed of the slower belt conveyor. In this manner, successive printed products are caused to shingle and decelerate irrespective of unequal spacing between the conveyed printed products due to removal of dissimilar size transverse scrap or blanket gaps or non-image waste strips between individual printed products.

Further objects, features and advantages of the invention, together with the organization and manner of operation thereof, will become apparent from the following detailed description of the invention taken in conjunction with the accompanying drawings wherein like reference numerals designate like elements throughout the several views.

DETAILED DESCRIPTION OF THE DRAWINGS

Figure 1:
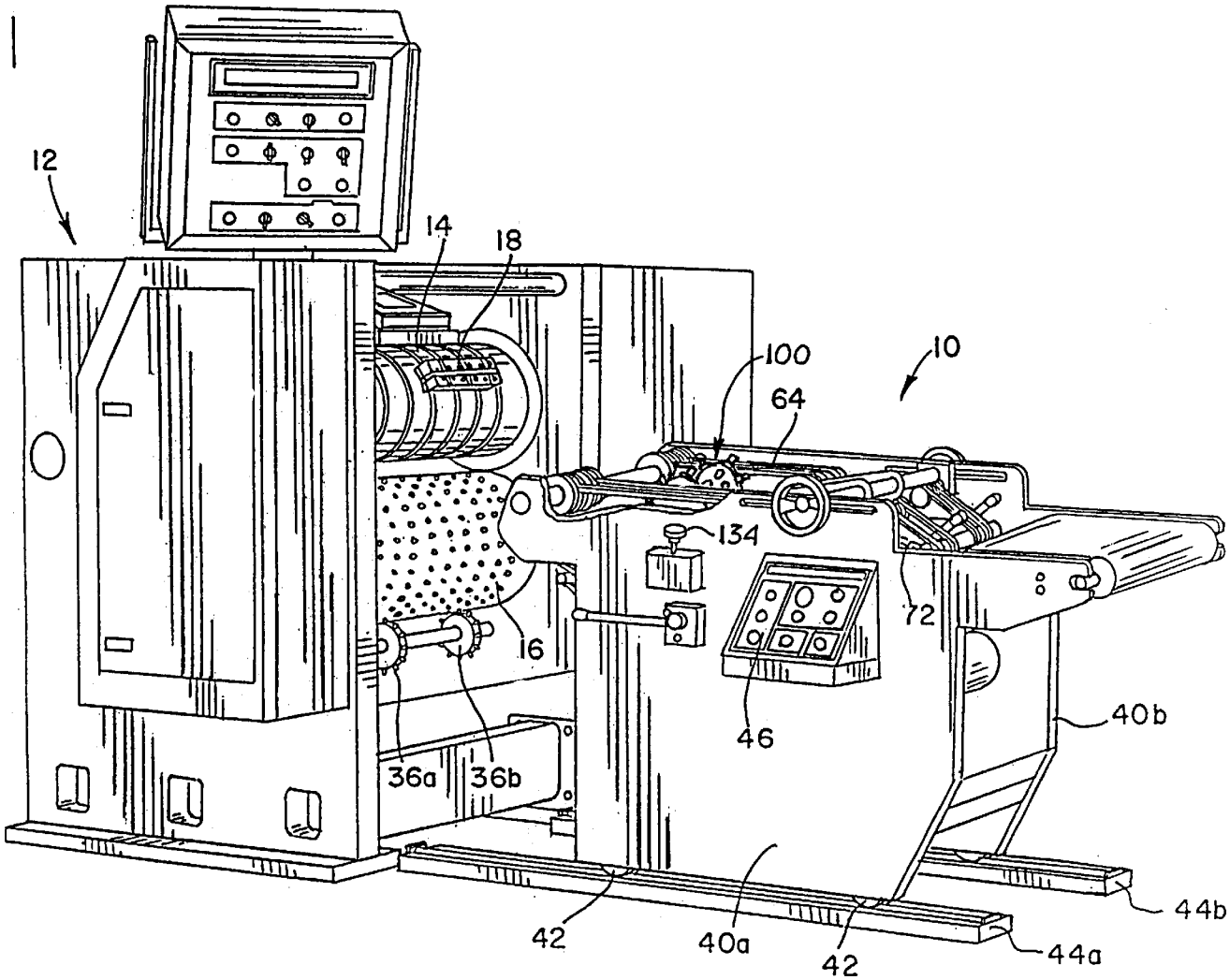
FIG. 1 is a perspective view of a variable rotary cutter and associated printed product delivery arrangement in accordance with the present invention.

Referring now to the drawings, and in particular to FIG. 1, a printed product delivery system or arrangement for decelerating and shingling printed products in accordance with the present invention is indicated generally at 10. The delivery system or arrangement 10 serves to decelerate and effect shingling of printed products received from a variable rotary cutter, indicated generally at 12, as the products are conveyed from a high speed belt conveyor to a slower speed belt conveyor, as will be described. The variable rotary cutter 12 is preferably of known computer controlled design, such as commercially available from Scheffer, Inc., Merrillville, Ind., and includes a rotary knife cylinder 14 and a parallel anvil cylinder 16 which are operative to rotate in timed relation in a known manner. The knife cylinder 14 is adapted to carry a plurality of knife or cutter blade assemblies, one of which is indicated at 18, about the periphery or circumference of the knife cylinder so that the knife blade assemblies cooperate with the anvil cylinder to cut or sever a continuous web of paper received from a rotary printing press, as schematically illustrated at 20 in FIG. 10. The printing press 20 typically includes upper and lower printing plate cylinders 22*a* and 22*b* which determine the press repeat length, and a pair of upper and lower blanket cylinders 24*a* and 24*b* which print on both sides of a continuous web of paper or the like, indicated at 26 in FIG. 9, passed through the nip defined between the blanket cylinders.

Figure 9:
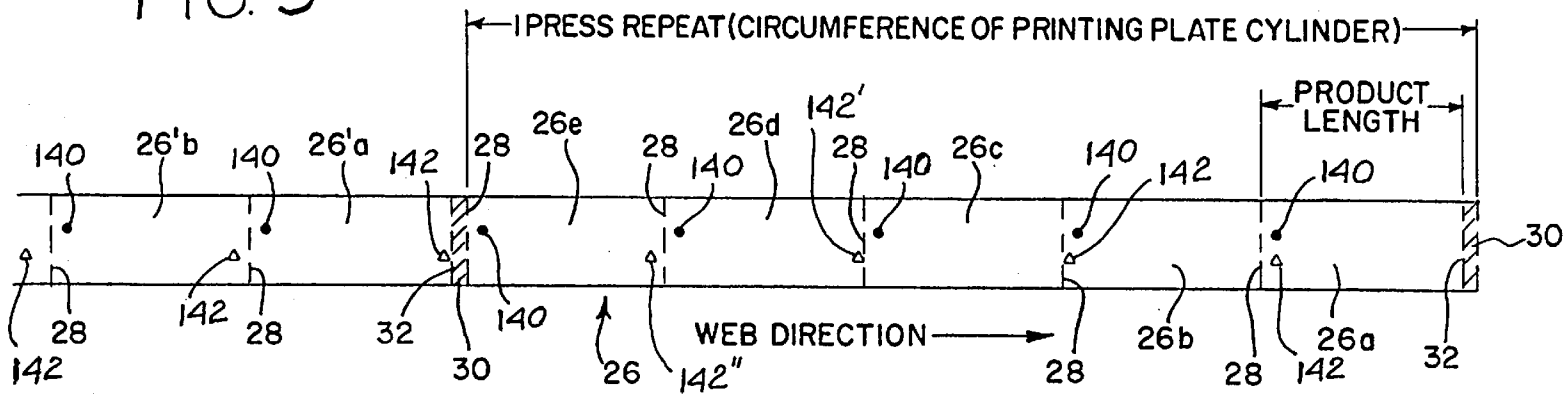
FIG. 9 is a schematic plan view of a length of printed web showing in dash lines the transverse cuts made by the rotary cutter between individual products after leaving the printing press, and also showing the points of contact with the depressor wheel of the subject invention as compared to points of contact made with knock-down arms as used in prior printed product delivery systems.
Figure 10:
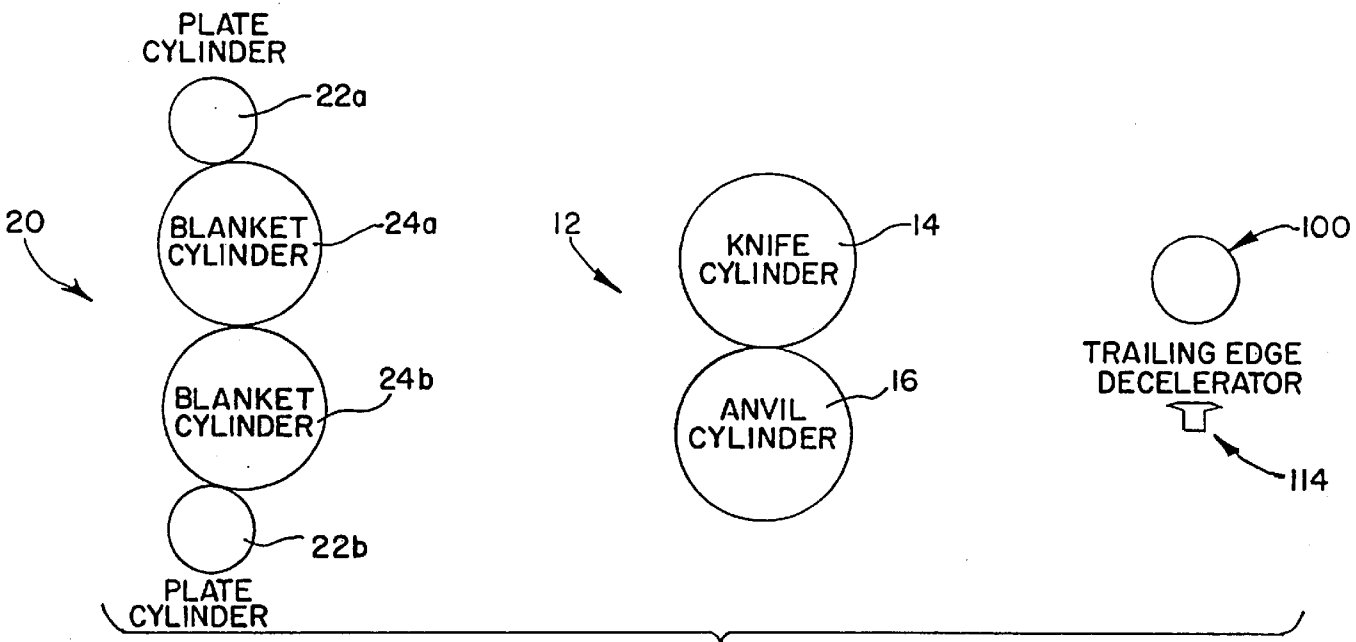
FIG. 10 is a schematic diagram illustrating the relative sequence positions of printing cylinders, rotary cutter, and rotary kicker wheel/brake pad arrangement operative to print, cut and shingle printed products in accordance with the present invention.

The knife cylinder 14 and anvil cylinder 16 of the variable rotary cutter 12 define a nip therebetween which receives the printed web from the rotary printer 20 so as to sever a repeat length of the web into a plurality of substantially equal length printed products, indicated at 26*a–e* in FIG. 9, separated by transverse butt cuts indicated by dash lines 28. In printing a continuous web with a rotary press, a transverse scrap or blanket gap will frequently be formed at the forward or rearward end of each press repeat, such as indicated at 30 at the forward end of each press repeat length of web 26. The rotary cutter is operative to remove the blanket gaps as by effecting a transverse cut 32 which defines the leading edge of the first printed product in a press repeat length of web coming from the printer such as represented by printed products 26*a–e* of a first repeat length of web, and printed products 26'*a* and 26'*b* at the leading end of a second repeat length of the web.

As is known, a length of printed web coming from a rotary printer may also have non-image waste strips formed between the individual equal length printed products, such as 26*a–e*. In this situation, the rotary cutter blades are positioned so as to remove the transverse non-image waste strips between the individual printed products as they are severed and conveyed downstream from the rotary cutter. If desired, the printed web may be passed through an in-line finishing system (not shown) prior to passing through the rotary cutter 12. The knife cylinder 14 is illustrated schematically in FIG. 10 as having a diameter twice the diameter of the printing plate cylinders 22*a* and 22*b* so that each 180° circumference of the knife cylinder has a similar arrangement of knife cutters to transversely cut or sever a press repeat length of the printed web. Alternatively, the printing plate cylinders 22*a* and 22*b* may be made of a diameter equal to the diameter of the knife cylinder 14 in which event the cutter knives carried about the knife cylinder would be circumferentially spaced to remove the blanket gaps 30 and form substantially equal length printed products along each press repeat length of web by transverse butt cuts 28 or cuts sufficient to remove non-image waste strips between successive printed products. As illustrated in FIG. 1, the rotary cutter 12 includes a pair of pin wheels 36*a* and 36*b* which operative to remove chips or waste strips removed from the cutter cylinder 14 by radial pins disposed about the anvil cylinder in a known manner.

Referring again to FIG. 1, the printed product delivery system or arrangement 10 includes a pair of side frames or plates 40*a* and 40*b* which are secured in upstanding laterally spaced relation by cross frame members (not shown) . The side frame plates 40*a* and 40*b* have rollers 42 mounted at their lower edges to facilitate movement in a pair of tracks 44*a* and 44*b* disposed transverse to a vertical plane containing the rotational axes of the knife and anvil cylinders 14 and 16 and enabling movement of the product delivery system into close proximity to the rotary cutter or to a position spaced from the rotary cutter to facilitate service or adjustment of the various components of the rotary cutter as well providing access to a forward end of the product delivery system. A control panel 46 is mounted on the side frame 40*a* to facilitate operator control of various functions of the product delivery system.

Figure 2:
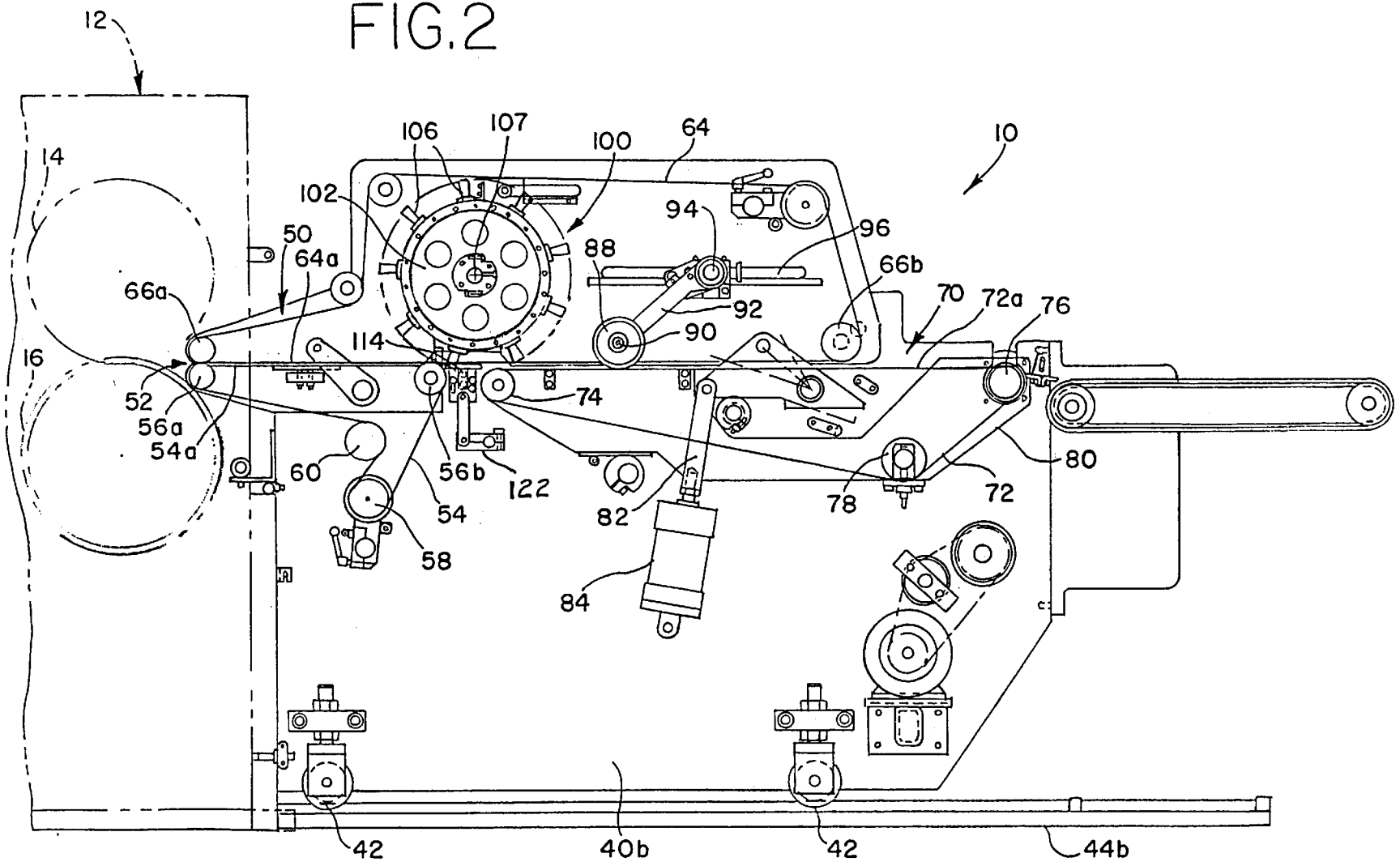
FIG. 2 is a side elevational view of a modified embodiment of the product delivery arrangement of FIG. 1, the near side frame wall being removed and portions broken away for clarity and the rotary cutter being schematically illustrated in phantom.

Referring to FIG. 2, the product delivery system 10 has a first relatively high speed belt conveyor, indicated generally at 50, mounted between the side frame plates 40*a* and 40*b* such that the high speed conveyor defines an entry nip 52 which is configured and at a height adapted to receive printed products, such as 26*a–e*, etc., from the rotary cutter 12. The high speed belt conveyor 50 includes a plurality of laterally spaced lower endless belts 54 each of which is reeved about and supported by a plurality of idler rollers including a pair of horizontally aligned rollers 56*a* and 56*b* which establish a reach 54*a* extending horizontally rearwardly or downstream from the receiving nip 52. Each conveyor belt 54 is also reeved about an idler pulley 58 which is adjustable to selectively adjust the tension in the conveyor belt with respect to a drive roller 60 controlled by a suitable drive motor.

The high speed belt conveyor 50 also includes a plurality of upper endless belts 64 equal in number to the lower belts 54 and which are reeved about a suitable idler roller 66*a* and a roller 66*b* to define a horizontal reach 64*a* which overlies the reach 54*a* of the lower conveyor belt so as to cooperate therewith to convey printed products from the rotary cutter through the horizontal path defined between reaches 54*a* and 64*a* at an accelerated speed. For example, the surface speed imparted to each printed product by the rotary cutter 12 may approach approximately 1,000 fpm which is then accelerated by the high speed conveyor 50 to a surface speed of approximately 1,100 fpm to 1,200 fpm or higher.

The product delivery system 10 also includes a slower speed belt conveyor, indicated generally at 70, which is supported between the upstanding side frames 40*a* and 40*b* and is operative to receive printed products from the high speed conveyor 50. The belt conveyor 70 includes one or more conveyor belt 72. The slower speed conveyor belts 72 is reeved about a forward idler roller 74 and a rearward drive roller 76 so as to define a horizontal reach 72*a* parallel to and spaced below the rearward end of the horizontal reach 64*a* of the upper conveyor belts 64 a distance greater than the thickness of the printed products being conveyed through the product delivery system 10. The idler roller 74, drive roller 76; and tension adjustment rollers 78 for the belt 72 are preferably mounted on a carriage 80 which is pivotal about the axis of the drive roller 76 by means of a control linkage 82 actuated by a solenoid controlled double acting cylinder 84 which enable the horizontal conveyor reach 72*a* to be moved downwardly to clear any paper jams or the like.

The drive roller 76 is driven by a drive motor or other suitable drive means so as to establish a surface speed of approximately 300 fpm along the horizontal reach 72*a* of the conveyor belt 72. With the high speed belt conveyor 50 and slower speed belt conveyor 70 being supported as aforedescribed, each printed product received by the high speed conveyor from the rotary cutter 12 will have its surface speed accelerated as the printed product is conveyed by the high speed conveyor belts 54 and 64. As each successive printed product exits from the exit end of the lower high speed conveyor belts 54, as established by the idler roller 56*b*, it will traverse the gap between the downstream idler roller 56*b* of the high speed belt conveyor and the upstream idler roller 74 of the slower speed belt conveyor and pass onto the horizontal reach of the slower speed conveyor belts 72.

In order to reduce the surface speed of each printed product entering the slower speed belt conveyor from the higher speed belt conveyor, at least one, and preferably two or more axially aligned headstop idler rollers 88 are supported on a transverse support shaft or axle 90 which in turn is supported on the outer ends of one or more pivot arms 92 having their upper ends pivotally mounted on a transverse support shaft 94. The pivot arms 92 and headstop rollers 88 are supported on a horizontal track 96 in a manner to enable horizontal adjustment of the headstop rollers 88 relative to the upstream idler roller 74 of the slower speed conveyor 70. The headstop rollers 88 are urged by gravity against the upper surface of the horizontal belt reach 72*a* of the slower speed belt conveyor 70 and define a nip therewith so that the leading edge of each successive printed product will enter the nip and undergo immediate deceleration.

The headstop rollers 88 are spaced from the upstream idler roller 74 of the slower belt conveyor 70 a distance slightly less than the longitudinal length of the printed products being cut from the printed web so that as the leading edge of each successive printed product enters the headstop nip, its trailing edge will overlie the gap between the high speed and low speed belt conveyors 50 and 70.

Figures 3, 4, 5:
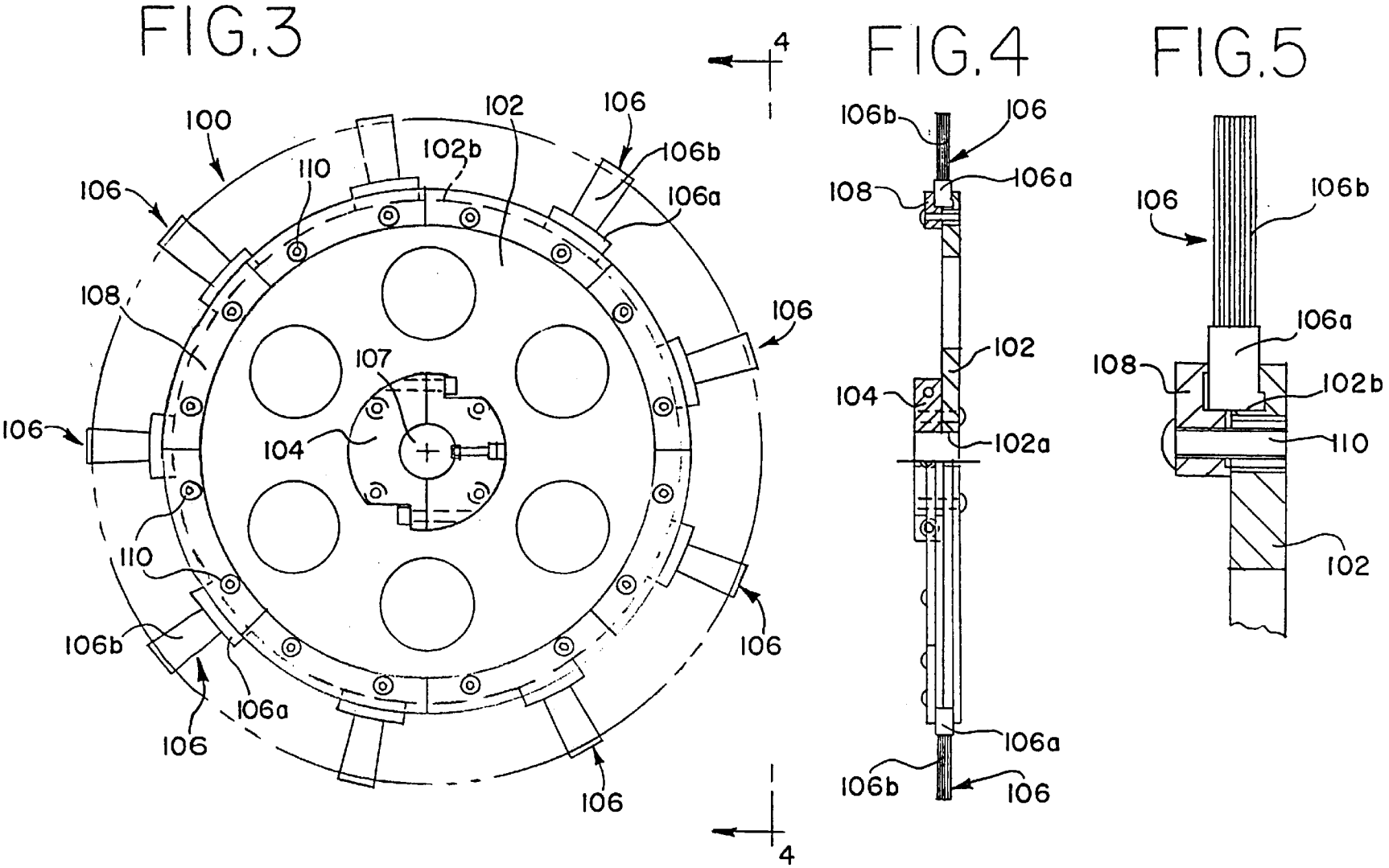
FIG. 3 is a side view, on an enlarged scale, of a depressor or kicker wheel as employed in the product delivery arrangement of FIG. 2.
FIG. 4 is a side edge view of the kicker wheel illustrated in FIG. 3, taken along lines 4—4 of FIG. 3.
FIG. 5 is a fragmentary sectional view illustrating the manner of mounting the depressor or kicker brushes on the kicker wheel of FIG. 3.

In accordance with one feature of the present invention, at least one and preferably a pair of axially aligned depressor or kicker wheels, one of which is indicated generally at 100 in FIG. 2, are mounted between the upstanding frame plates 40*a* and 40*b* for rotation about a transverse rotational axis which overlies the gap between the high speed and low speed conveyors. Referring to FIGS. 3–5, taken with FIG. 2, each of the depressor or kicker wheels 100 includes a generally circular wheel plate 102 having a circular center opening 102*a* and to which is coaxially connected a mounting hub 104 to facilitate mounting of the depressor or kicker wheels on a transverse rotatably driven axle 107 journaled between the upstanding frame plates 40*a* and 40*b*. The axle 107 is connected to a suitable drive motor (not shown) to effect rotation of the kicker wheels 100 in a counterclockwise direction, as viewed in FIG. 2. Each kicker wheel carries a plurality of depressor or kicker members 106 which correspond in number to the number of cutter blades spaced about the cutter cylinder 14 that establish the trailing edges of the printed products formed from the printed web. In the illustrated embodiment, each of the depressor or kicker members 106 has a base 106*a* which may be made of a suitable plastic material and which has a generally arcuate side profile so as to seat on an annular rim surface 102*b* formed on the wheel 102 concentric to its center axis. The kicker members 106 may be secured in selected circumferential position about the axis of the kicker wheel by an annular retaining ring 108 which is releasably attached to the wheel plate by fasteners 110 as illustrated in FIG. 5. The base 106*a* of each kicker member 106 has a plurality of brush bristles 106*b* secured therein such that the bristles extend generally radially outwardly from the rotational axis of the kicker wheel and have outer ends lying in a circle concentric to the rotational axis of the kicker wheel and having a diameter substantially equal to the diameter of the circular path traversed by the outer cutting edges of the knife blades carried on the rotary cutter 14.

The kicker wheels 100 are positioned to overlie the gap between the high speed and low speed belt conveyors 50 and 70 so that as the kicker wheels rotate, the outer end of each depressor or kicker member 106 will momentarily depress the trailing edge of a printed product whose leading edge has entered the headstop nip, thereby enabling the leading edge of the next successive printed product to pass over the depressed trailing end and shingle therewith.

As aforedescribed, the depressor or kicker members 106 are spaced circumferentially about the kicker wheel plate 102 so as to angularly correspond to each of the cutter blades on the cutter cylinder 14 which create a trailing edge on a printed product formed from the printed web. The rotational speed and angular position of each of the depressor or kicker members 106 is in circumferential registry with the corresponding cutter knives on the knife cylinder 14 by means of a conventional harmonic drive or differential gear box, as is known. The registry or phasing may be adjusted by an operator to obtain desired timing in depressing the trailing edge of each successive printed product along with timing of entry of the leading edge onto the headstop nip and adjustment of the surface speed of the conveyor belts 72.

In accordance with another feature of the present invention, a brake pad, indicated generally at 114, is supported slightly beneath the path traversed by the printed products as they traverse the gap into the slower speed conveyor 70. The brake pad 114 is positioned to generally vertically underlie the rotational axis of the depressor or kicker wheels 100 and is adjustable to cooperate with each of the depressor or kicker members 106 as it depresses the trailing edge of a printed product so as to sandwich the trailing edge between the kicker member and the brake pad and apply a frictional deceleration to the corresponding printed product. This additional deceleration momentarily imparted to the forwardly moving printed product as its forward edge enters the headstop nip substantially increases the rate of deceleration slowing the printed product down to the substantially slower surface speed of the slower speed conveyor belts 72, thereby preventing or inhibiting wrinkling or other damage to the printed products.

Figure 6:
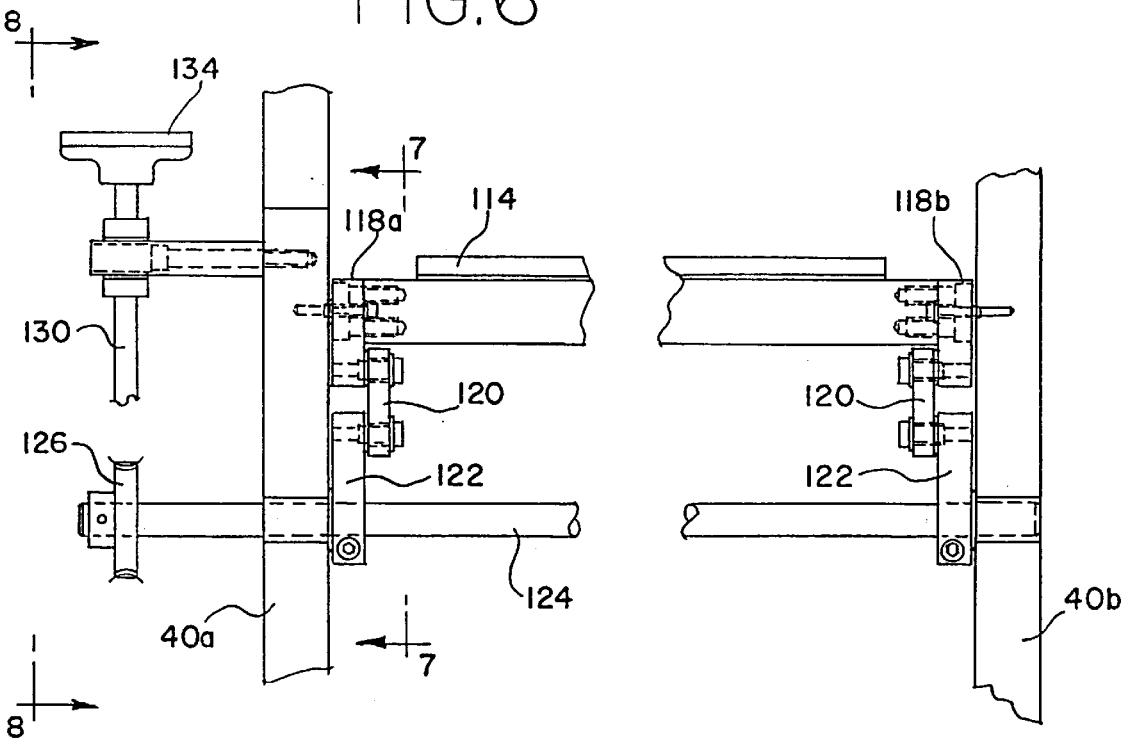
FIG. 6 is a laterally foreshortened generally vertical sectional view illustrating the manner of supporting the adjustable brake pad illustrated in FIG. 2.
Figure 7:
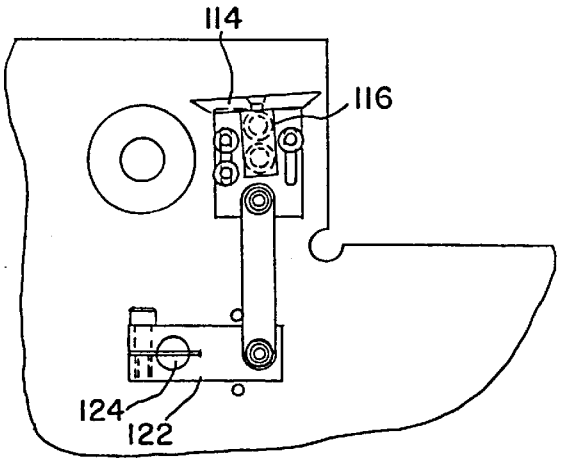
FIG. 7 is a fragmentary detail view taken substantially along line 7—7 of FIG. 6 illustrating the brake pad and associated support linkage.
Figure 8:
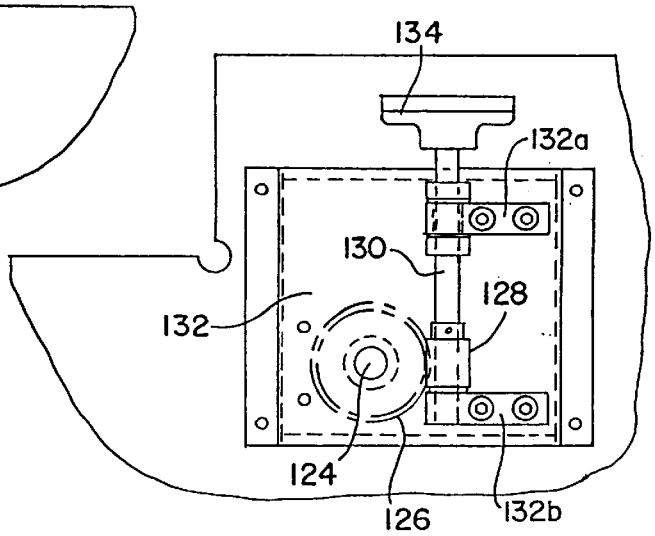
FIG. 8 is a fragmentary side elevational view taken substantially along line 8—8 of FIG. 6 illustrating the adjustment mechanism for the brake pad.

Referring to FIGS. 6–8, taken in conjunction with FIG. 2, the brake pad 114 is supported in transverse relation to the conveyor path defined by the high and low speed conveyors 50 and 70, respectively, and extends laterally between the upstanding side frame plates 40*a* and 40*b* so as to underlie the laterally spaced kicker wheels 100. As illustrated in FIG. 6, the brake pad 114 is supported on the upper surface of a laterally extending support bar 116 which has its opposite ends fixed to slide plates 118*a* and 118*b*, both of which are mounted on the inner surfaces of the respective side plates 40*a* and 40*b* so as to enable generally vertical movement of the slide plates and thereby the brake pad 114. Each of the slide plates 118*a* and 118*b* is pivotally secured to the upper end of a pivot link 120 having its lower end pivotally connected to a rocker arm 122 which in turn is mounted on a transverse pivot shaft 124 extending between and rotatably supported by the upstanding frame plates 40*a* and 40*b*. In the illustrated embodiment, the end of the pivot shaft adjacent the side frame 40*a* extends through the side plate and has a gear 126 mounted in fixed relation thereon. The gear 126 is in meshing relation with a worm gear 128 which is mounted coaxially on a control shaft 130. The shaft 130 is supported by a pair of brackets 132*a* and 132*b* which are mounted on a plate 132 fixed to the outer surface of the side frame 40*a* so as to allow rotation of the shaft 130, and thereby the worm gear 128, about its longitudinal axis by means of a handle 134, as illustrated in FIG. 8.

With the brake pad 114 supported for substantially vertical adjustment relative to the outer circular path traversed by the outer ends of the kicker members 106, it will be appreciated that the brake pad may be adjusted to vary the frictional relation between the successive kicker members 106 and the trailing edges of the printed products as their trailing edges are depressed, thereby facilitating shingling and also decelerating the products more quickly to the slower surface speed of the conveyor belts 72.

As aforedescribed, the knife or cutter blades carried by the knife cylinder 14 are adjustable about the periphery of the cutter cylinder so as to cut the printed web 26 to remove any blanket gap, such as indicated at 30 in FIG. 9, from the lead end of the press repeat length of the web, and then butt cut the web transversely, such as at 28, to create a number of equal length printed products as established by the print cylinders 22*a* and 22*b* during each revolution or press repeat. Alternatively, the knife blades on the cutter cylinder may be positioned to trim any blanket gap created in a given press repeat length of printed web and to cut out any bleed trim between the resulting equal length printed products within the given press repeat length of web. As a result of removing the blanket gaps from a press repeat length of web, the printed products cut from the printed web will be equally spaced as they leave the knife cylinder except for the spacing between the trailing edge of the last printed product of a press repeat length of web and the leading edge of first printed product of the next repeat length of web. The decelerating arrangement established by the depressor or kicker wheels 100 and brake pad 114 of the present invention compensates for any uneven spacing between successive printed products conveyed from the high speed conveyor 50 to the slower speed conveyor 70 by spacing the depressor or kicker members about the kicker wheel in angular circumferential positions corresponding to the knife blades on the knife cylinder which establish the trailing edges of successive printed products formed from the printed web.

By spacing the depressor or kicker brushes 106 about the circumference of the kicker wheels 100 in corresponding angular relation to the knife blades on the rotary cutter which establish the trailing edges of successive printed products, the depressor or kicker brush on the depressor wheel which corresponds to the last-to-cut knife blade on the rotary cutter will momentarily engage and depress the trailing edge of the corresponding printed product as its leading edge enters the headstop nip of the slower belt conveyor to enable the leading edge of the next succeeding printed product to pass over the depressed trailing edge and effect shingling. Simultaneously this kicker brush will cooperate with the brake pad 114 to decelerate the corresponding printed product to a speed close to the surface speed of the conveyor belts of the slower belt conveyor. In this manner, successive printed products are caused to shingle and decelerate irrespective of unequal spacing between the conveyed printed products due to removal of dissimilar size transverse scrap or blanket gaps or non-image waste strips between individual printed products.

Having thus described various features of the present invention, it will be appreciated that by providing for selective positioning of the depressor or kicker members 106 about the periphery of each depressor or kicker wheel 100, alternatively termed knockdown wheels, so that the depressor members correspond in number and angular circumferential positions to the knives or cutter blades on the rotary cutter 14 that create the trailing edges of the sheet products severed from each repeat length of web, and by rotating the depressor wheels in predetermined phase relation to the rotary cutter, each depressor or kicker member will engage and depress the trailing end of a sheet product severed by the corresponding angularly positioned knife blade on the rotary cutter irrespective or irregular spacing of the sheet products between the leading and trailing ends of each repeat length of web. This leads to consistent points of contact between the depressor members 106 with the irregularly spaced sheet products relative to the trailing edges, such as represented by the solid dots 140 on the sheet products 26*a–e* and 26'*a,b* in FIG. 9, whether or not non-image waste strips are removed from between successive sheet products in addition to removal of a blanket gap 30 from the leading or trailing end of each repeat length of web.

In contrast, prior art tail end knockdown or snubber devices employ either a single snubber member carried on a rotary knockdown wheel, or a plurality of knockdown or snubber members carried in fixed equal circumferentially spaced positions about the periphery of the knockdown wheel. This results in the prior art knockdown or snubber members reaching their product knockdown positions, as represented by the triangular symbols (Δ) 142 in FIG. 9, at equally spaced intervals relative to the path transversed by sheet products moving downstream from the rotary cutter. As a result, when sheet products are severed by the rotary cutter from a repeat length of web so that the sheet products are irregularly spaced as they are conveyed downstream from the cutter, the prior art knockdown members do not engage successive sheet products at consistent points of contact relative to their trailing edges 28. By failing to compensate for irregular spacing of the sheet products within a repeat length of web, the distance between the prior art knockdown points of contact 142 and the desired knockdown points of contact 140 increases, thus resulting in a progressively increasing or cumulative error to the point where the prior art knockdown or snubber members actually miss engaging one or more sheet products adjacent their trailing ends and contact the leading ends of the next successive sheet products.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. A method of shingling products cut from a longitudinally moving substantially continuous web of sheet material by a rotary cutter having a plurality of knife blades mounted in circumferential angularly spaced relation thereon so as to create, within a predetermined longitudinal length of said web, a plurality of irregularly spaced sheet products having leading and trailing edges, and wherein said plurality of products are conveyed in irregular spaced relation along a first conveyor path at a first longitudinal speed and thereafter conveyed along a second conveyor path at a second longitudinal speed less than said first longitudinal speed, said method comprising the steps of:

providing at least one knockdown wheel disposed generally above and adjacent an upstream end of said second conveyor path, said knockdown wheel being rotatable about an axis generally parallel to a rotational axis of said rotary cutter and carrying a plurality of depressor members corresponding in number to said knife blades on said rotary cutter that create said trailing edges of said irregularly spaced sheet products, said depressor members being spaced about said rotatable axis of said knockdown wheel in substantially the same circumferential angularly spaced relation as said circumferential angular spacing of said knife blades on said rotary cutter that create said trailing edges of said irregularly spaced sheet products.

rotating said knockdown wheel in phase relation to said rotary cutter so that each depressor member engages and depresses the trailing edge of the conveyed spaced product cut by the corresponding one of said knife blades carried on said rotary cutter at substantially the same angular position as said depressor member so as to enable the leading edge of the next successive sheet product to pass above the depressed trailing edge in shingled fashion, and substantially simultaneously contacting the depressed trailing edge of each successive sheet product with a brake pad so as to apply a braking force to and decelerate each successive sheet product as said successive sheet product passes between said first and second conveyor paths.

2. The method of claim 1 wherein said rotary cutter is disposed generally transverse to said path traversed by said web.

3. The method of claim 2 wherein said depressor members comprise brushes carried by said wheel in circumferential spaced relation about said wheel, each said brush having generally radially directed bristles, said step of depressing said trailing edge of each product further comprising the step of engaging an upper surface of said trailing edge of each product entering said second conveyor path so as to depress said trailing edge against said brake pad.

4. The method of claim 3 wherein said knife blades on said rotary cutter have outer cutting edges, and including the steps of positioning said knife blades so that said outer cutting edges lie on a first circle concentric to said axis of rotation of said rotary cutter, and positioning said brushes so that outer tips thereof lie on a second circle concentric to said rotational axis of said wheel and having a diameter substantially equal to a diameter of said first circle.

5. The method of claim 4 including means for adjusting said brake pad relative to the circular path traversed by said outer tips of said brushes so as to enable establishment of a variable frictional braking relation between said brake pad and said sheet products as the trailing edges of said sheet products are depressed against said break pad whereby to effect deceleration of said sheet products.

* * * * *

UNITED STATES PATENT AND TRADEMARK OFFICE

CERTIFICATE OF CORRECTION

PATENT NO. : 5,950,510

DATED : September 14, 1999

INVENTOR(S) : Scheffer et al.

It is certified that error appears in the above-identified patent and that said Letters Patent is hereby corrected as shown below:

Column 5, line 64, "DETAILED DESCRIPTION OF THE DRAWINGS" should read --"DETAILED DESCRIPTION"--.

Column 6, line 66, the word --are-- should follow "which".

Column 11, line 16, "the" should read --their--.

Signed and Sealed this

Twenty-seventh Day of June, 2000

*Attest:*

Q. TODD DICKINSON

*Attesting Officer*

*Director of Patents and Trademarks*